US009342024B2

(12) United States Patent
Maeda et al.

(10) Patent No.: US 9,342,024 B2
(45) Date of Patent: May 17, 2016

(54) IMAGE FORMING APPARATUS

(71) Applicant: Konica Minolta, Inc., Chiyoda-ku (JP)

(72) Inventors: Hiroyuki Maeda, Toyokawa (JP); Yoshiyuki Toso, Toyokawa (JP); Yasuhiro Suzuki, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/466,192

(22) Filed: Aug. 22, 2014

(65) Prior Publication Data

US 2015/0055996 A1 Feb. 26, 2015

(30) Foreign Application Priority Data

Aug. 22, 2013 (JP) ..... 2013-171992

(51) Int. Cl.
*G03G 15/00* (2006.01)
*G03G 21/00* (2006.01)

(52) U.S. Cl.
CPC .. *G03G 15/6576* (2013.01); *G03G 2215/00611* (2013.01); *G03G 2215/00616* (2013.01)

(58) Field of Classification Search
CPC ..... G03G 15/6576; G03G 2215/00611; G03G 2215/00616
See application file for complete search history.

(56) References Cited

U.S. PATENT DOCUMENTS

| | | | | |
|---|---|---|---|---|
| 4,926,358 | A * | 5/1990 | Tani et al. | 700/302 |
| 8,131,192 | B2 * | 3/2012 | Honguh et al. | 399/289 |
| 2004/0008245 | A1 * | 1/2004 | Hirai et al. | 347/129 |
| 2011/0196650 | A1 * | 8/2011 | Yang et al. | 702/166 |

FOREIGN PATENT DOCUMENTS

JP 2005-008320 A 1/2005

* cited by examiner

*Primary Examiner* — Blake A Tankersley
*Assistant Examiner* — John M Royston
(74) *Attorney, Agent, or Firm* — Buchanan Ingersoll & Rooney PC

(57) ABSTRACT

In an image forming apparatus, a sensor section includes a sheet path through which the sheet passes in a sheet feeding direction. In the sensor section, a light source unit emits light to an irradiation area set in the sheet path. Here, the light is elongated in a main-scanning direction and has quantities of light varying according to positions in the main-scanning direction and according to positions in a height direction perpendicular to a sheet feed surface. In addition, in the sensor section, a light-receiving section receives light diffused in a predetermined diffusing direction among the light emitted from the light source and then irradiated to the sheet passing in the sheet path and outputs information representing quantities of the received light. In the image forming apparatus, a control section extracts a parameter from the information and derives an amount of curl of the sheet.

14 Claims, 16 Drawing Sheets

IMAGE FORMING APPARATUS

This application claims benefit of priority to Japanese Patent Application No. 2013-171992 filed Aug. 22, 2013, the content of which is incorporated herein by reference.

BACKGROUND OF THE INVENTION

1. Technical Field

The present invention relates to an image forming apparatus capable of detecting the amount of possible curl of a sheet having a toner image formed thereon.

As an example of conventional image forming apparatuses of this type, an apparatus disclosed by Japanese Patent Laid-Open Publication No. 2005-008320 is known. In an image forming apparatus of this type, a two-dimensional area sensor (which will be hereinafter referred to simply as a sensor) is provided in the vicinity of a sheet path and downstream from a fixing device. This sensor obtains a thermal image of a sheet traveling from the fixing device downstream in the sheet path, and detects curl of the sheet based on the obtained thermal image.

In such a conventional image forming apparatus, it is necessary to provide a sensor to be used exclusively for detection of curl, which results in an increase in the cost of the image forming apparatus. Also, it is necessary to make a space for the sensor in the image forming apparatus, which results in an increase in the size of the image forming apparatus.

SUMMARY OF THE INVENTION

It is an object of the present invention to provide an image forming apparatus capable of detecting curl of a sheet at low cost without causing an increase in the size of the image forming apparatus.

According to an aspect of the present invention, an image forming apparatus comprises: an image forming section configured to form a toner image on a sheet; a fixing section configured to fix the toner image formed by the image forming section on the sheet and to feed the sheet out therefrom; and a sensor section configured to read the toner image on the sheet fed from the fixing section.

The sensor section includes: a sheet path configured to lead the sheet fed from the fixing section to pass in a predetermined sheet feeding direction; a light source unit configured to emit light toward an irradiation area preliminarily set in the sheet path, the light being elongated in a main-scanning direction different from the sheet feeding direction and having quantities of light varying according to positions in the main-scanning direction and according to positions in a height direction perpendicular to a sheet feed surface; and a light-receiving section configured to receive light diffused in a predetermined diffusing direction different from the sheet feeding direction and the main-scanning direction among the light emitted from the light source and then irradiated to the sheet passing in the sheet path, and to output information representing quantities of the received light.

The image forming apparatus further comprises: a control section configured to extract a predetermined parameter from the information output from the light-receiving section and to derive an amount of curl of the sheet passing in the sheet path.

DETAILED DESCRIPTION OF THE PREFERRED EMBODIMENTS

Embodiment

An image forming apparatus according to an embodiment of the present invention will be hereinafter described with reference to the drawings.

Figure 2A:
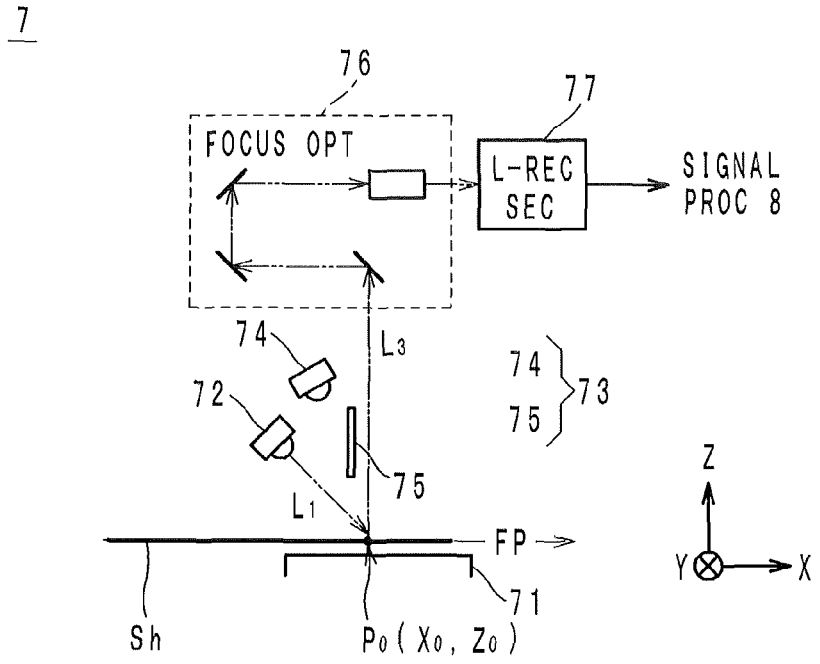
FIG. 2A is a first diagram illustrating a detailed structure of a sensor section shown in FIG. 1.

First, the X-axis, Y-axis and Z-axis drawn in FIG. 2A and other drawings are described. The X-axis, Y-axis and Z-axis are perpendicular to one another. More specifically, for the convenience of description, the X-axis indicates a sheet feeding direction in which a sheet Sh passes through an irradiation area $P_0$ where the sheet Sh is irradiated with light emitted from a sensor section 7. The Y-axis indicates a main-scanning direction in which light $L_1$ and light $L_2$ are elongated. The Z-axis indicates a direction of travel of light $L_3$ (that is, a predetermined diffusing direction). The light $L_3$ is a part of the light $L_2$ diffused from the irradiation area $P_0$ and entering a focusing optical system 76.

Structure and Operation of the Image Forming Apparatus

Figure 1:
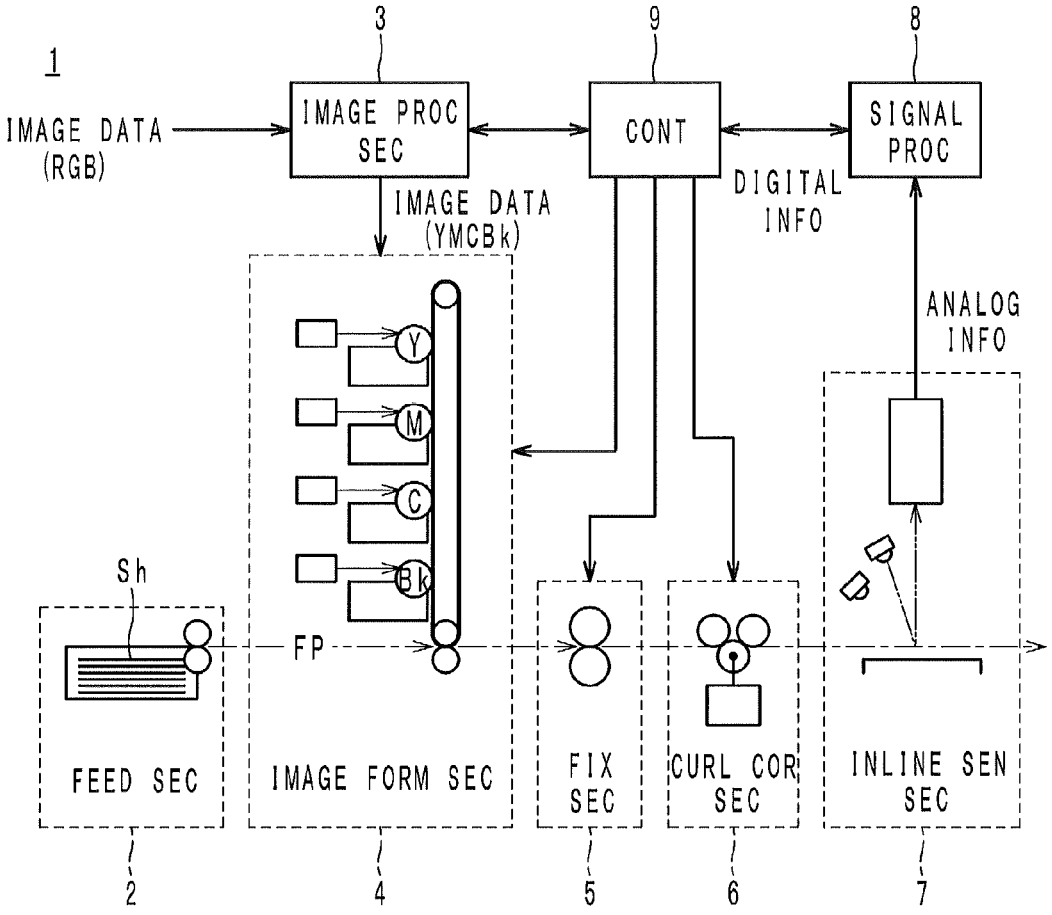
FIG. 1 is a diagram of an image forming apparatus according to an embodiment of the present invention.

In FIG. 1, the image forming apparatus 1 is, for example, a copier, a printer, a facsimile or a multi-function peripheral having functions of a copier, a printer, and a facsimile. The image forming apparatus 1 prints a full-color image on a sheet Sh (for example, a paper sheet or an OHP film) by, for example, an electrophotographic and tandem method. The image forming apparatus 1 generally comprises a sheet feed section 2, an image processing section 3, an image forming section 4, a fixing section 5, an inline sensor section (which will be referred simply as a sensor section) 7, a signal processing circuit 8, and a control circuit 9.

The sheet feed section 2 picks up one sheet from a stack of sheets stored therein and feeds the sheet into a sheet path FP drawn by the broken line.

Image data representing an arbitrary image to be printed are sent to the image processing section 3 from a personal computer connected to the image forming apparatus 1. In the image data sent to the image processing section 3, each pixel value, for example, includes values of R (red), G (green) and B (blue). The image processing section 3 is, for example, a gate array, and the image processing section 3, for example, converts each pixel value into values of Y (yellow), M (magenta), C (cyan) and Bk (black) to be used by the image forming section 4. In this way, the image processing section 3 generates image data with respect to each of the colors of Y, M, C and Bk. The image processing section 3 sends the generated image data with respect to each of the colors to the image forming section 4. The image processing section 3 may carry out the above-described color conversion by using software.

The image forming section 4, as well known, comprises charging sections, photoreceptor drums and developing devices for the respective colors Y, M, C and Bk, and further comprises an exposure device, an intermediate belt and a secondary transfer area. In the image forming section 4, the charging sections uniformly charge the peripheral surfaces of the corresponding photoreceptor drums while the photoreceptor drums are rotating. On receiving image data of Y, M, C and Bk from the image processing section 3, the exposure device generates light beams for the respective colors based on the image data. The exposure device radiates the light beams for the respective colors to the peripheral surfaces of the corresponding photoreceptor drums, so that electrostatic latent images for the respective colors of the arbitrary image are formed on the peripheral surfaces of the corresponding photoreceptor drums.

The developing devices for the respective colors supply toner to the electrostatic latent images formed on the peripheral surfaces of the corresponding photoreceptor drums while the photoreceptor drums are rotating. Thereby, toner images in accordance with image data of the colors Y, M, C and Bk resolved from the arbitrary image are formed on the respective photoreceptor drums.

The toner images in the respective colors are transferred from the photoreceptor drums to the same area of the intermediate transfer belt while the intermediate transfer belt is rotating. Thereby, a composite toner image representing the arbitrary image in full color is formed on the intermediate transfer belt, and the composite toner image is carried to the secondary transfer area by the intermediate transfer belt.

Meanwhile, the sheet Sh fed from the sheet feed section 2 is conveyed in the sheet path FP to the secondary transfer area in the image forming section 4. In the secondary transfer area, the composite toner image is transferred from the intermediate transfer belt to the sheet Sh (secondary transfer). After the secondary transfer, the sheet Sh is fed toward the fixing section 5 as a sheet with an unfixed image.

The fixing section 5 comprises two rotating bodies forming a fixing nip portion. In the fixing section 5, the sheet Sh having an unfixed image is fed into the fixing nip portion, and heated and pressed by the two rotating bodies. Through this fixing step, the unfixed composite image on the sheet Sh is fixed to the sheet Sh. After the fixing step, the sheet Sh is fed as an ordinary sheet Sh with the arbitrary image printed thereon from the fixing section 5 to a curl correcting section 6 located downstream in the sheet path FP.

Any one of various conventional curl removing devices (which are also referred to as decurlers) can be used as the curl correcting section 6 as long as it is capable of correcting the curl or bend of the sheet Sh while the sheet Sh is being fed. In this embodiment, the curl correcting section 6, for example, comprises a first, a second and a third cylindrical roller. These rollers extend in a direction perpendicular to the sheet path FP. The first and the third rollers are located respectively the most upstream and the most downstream along the sheet path among the three rollers. The second roller is located between the first and third rollers and contacts with the first roller and the third roller to form two nip portions. The curl correcting section 6 nips the sheet Sh fed from the fixing section 5 in the two nip portions to correct the curl or bend of the sheet Sh, and feeds the curl/bend-corrected sheet Sh toward the sensor section 7 located downstream in the sheet path FP. Each of the first through third rollers has an elastic surface layer. The curl correcting section 6 adjusts the strength of the force to correct the curl by changing the position of the second roller relative to the first and third rollers.

The sensor section 7 is provided mainly to carry out an image quality test. The image quality test is carried out at a time when the above-described printing is not carried out. The image quality test is carried out, for example, in the following way. The image forming section 4 and the fixing device 5 form a predetermined test chart image (that is, a pattern image) on a sheet Sh to make a test sheet Sh. The sensor section 7 irradiates the test sheet Sh fed thereto with first light having substantially constant quantities of light regardless of positions in the main-scanning direction. The sensor section 7 further receives a part of light diffused from the test sheet Sh and performs photoelectric conversion to generate analog information (which will be hereinafter referred to as first analog information) representing the colors of the toner image on the sheet Sh with RGB values, density values, or the like. Then, the sensor section 7 outputs the first analog information to the signal processing circuit 8.

The sensor section 7 is also used for detection of curl during a printing operation. Thus, the sensor section 7 is a multipurpose section. During a printing operation, ordinary sheets Sh with toner images (arbitrary images) printed thereon are fed to the sensor section 7 sequentially. As will be described in more detail later, the sensor section 7 irradiates each of the ordinary sheets Sh fed thereto with second light having quantities of light varying according to positions in the main-scanning direction. The second light directed to the sheet Sh is reflected by the sheet Sh and diffused in various directions. The sensor section 7 receives a part of the light diffused from the sheet Sh and performs photoelectric conversion to generate analog information (which will be hereinafter referred to as second analog information) indicating the quantities of received light relevant to positions in the main-scanning direction. Then, the sensor section 7 outputs the second analog information to the signal processing circuit 8.

Thereafter, the sensor section 7 feeds the sheet Sh downstream in the sheet path FP. The sheet Sh is finally ejected on a printed-sheet tray (not drawn).

The signal processing circuit 8 is, for example, implemented by a gate array or a software. At the time of image quality test, the signal processing circuit 8 converts the first analog information sent from the sensor section 7 into first digital information and outputs the first digital information to the control circuit 9. During a printing operation, on the other hand, the signal processing circuit 8 operates for detection of the amount of curl, and specifically, the signal processing circuit 8 converts the second analog information sent from the sensor section 7 into second digital information and outputs the second digital information to the control circuit 9.

The control circuit 9 includes a microcomputer, a main memory, a non-volatile memory, etc. The control circuit 9 controls the above-described printing process by operating in accordance with a program stored in the non-volatile memory.

At the time of image quality test, the control circuit 9 carries out image quality stabilization control and the like based on the first digital information received from the signal processing circuit 8. During a printing operation, on the other hand, the control circuit 9 detects the amount of curl of the sheet Sh based on the second digital information sent from the signal processing circuit 8 and carries out feedback control of the curl correcting section 6 based on the detected amount of curl. The detection of the amount of curl and the feedback control will be described later.

Detailed Structure of the Sensor Section

Figure 2B:
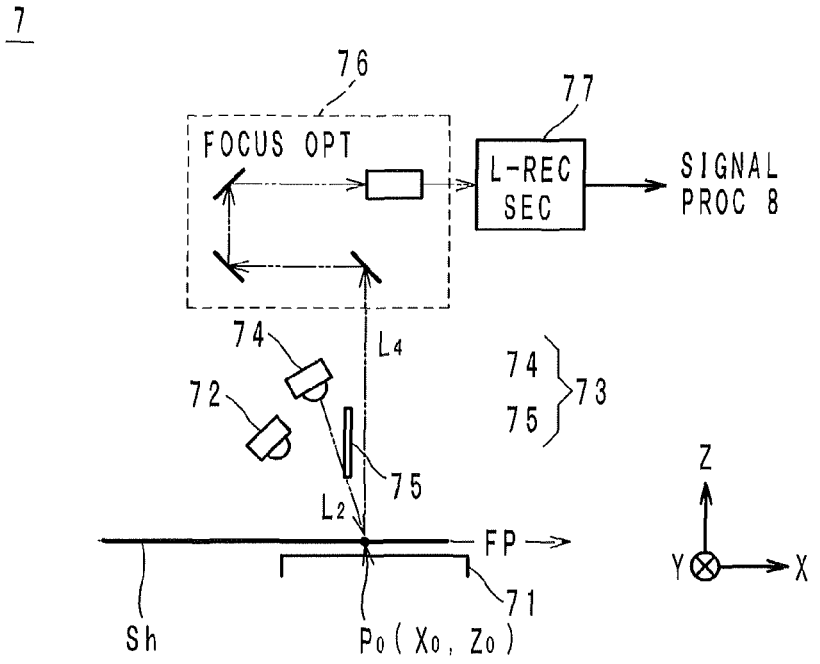
FIG. 2B is a second diagram illustrating the detailed structure of the sensor section shown in FIG. 1.
Figure 3:
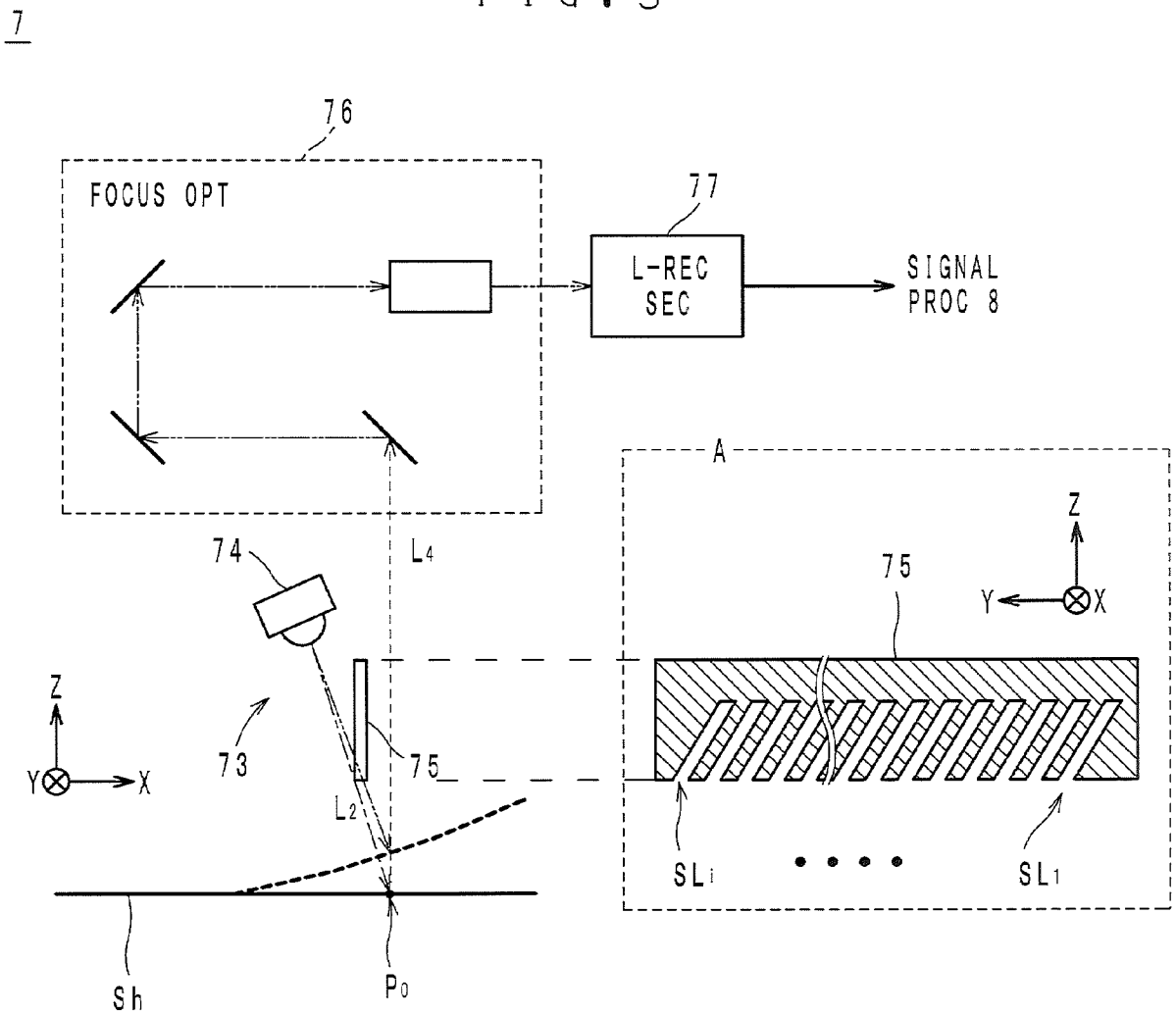
FIG. 3 is a diagram illustrating a detailed structure of a slit board shown in FIG. 2A.

Next, referring to FIGS. 2A, 2B and 3, the detailed structure of the sensor section 7 is described. In FIGS. 2A and 2B, the sensor section 7 includes a guide 71, a light source unit 73, a focusing optical system 76, and a light-receiving section 77. The light source unit 73 has a first light source 72 for the image quality test, a second light source 74 for detection of amount of curl, and a slit board 75.

The guide 71 is a member to define a part of the sheet path FP downstream from the fixing section 5 and the curl correcting section 6. A sheet Sh is fed from the curl correcting section 6 to the guide 71 (see FIG. 1). A surface of the guide 71 at the positive side in the Z-direction (that is, an upper surface of the guide 71) serves as a guide surface for the sheet Sh. Here, the upper surface of the guide 71 will be referred to as a sheet feed surface. The sheet Sh passes on through the sheet feed surface, and the guide 71 feeds the sheet Sh downstream in the sheet feeding direction along the sheet path FP toward the printed-sheet tray (not drawn) while regulating the position of the sheet Sh.

In the part of the sheet path FP defined by the guide 71, an irradiation area $P_0$ is preliminarily set. As understood from FIGS. 2A and 2B, the irradiation area $P_0$ is a linear area defined by an X-axis position of $X_0$ and a Z-axis position of $Z_0$, and the irradiation area $P_0$ extends in the main-scanning direction (i.e., Y-direction) across the printed sheet Sh passing on through the sheet feed surface of the guide 71.

Referring to FIG. 2A, the first light source 72 is, for example, an LED, a fluorescent lamp or a halogen lamp extending substantially in parallel to the irradiation area $P_0$, that is, extending in the main-scanning direction. Under the control of the control circuit 9, at the time of image quality test, the light source 72 emits the first light $L_1$ elongated in the main-scanning direction and having constant quantities of light $I_1$ regardless of positions in the main-scanning direction. Between the first light source 72 and the irradiation area $P_0$, there is no member to obstruct the optical path of the light $L_1$, and the light $L_1$ enters the sheet Sh while maintaining the quantities of light on positions in the main-scanning direction at substantially the constant value $I_1$.

Referring to FIG. 2B, the second light source 74 is an LED or the like and extends in the main-scanning direction, as the first light source 72 is. Under the control of the control circuit 9, the second light source 74 emits the second light $L_2$. The second light $L_2$, when emitted from the light source 74, has substantially constant quantities of light $I_2$ regardless of positions in the main-scanning direction, and is emitted toward the irradiation area $P_0$.

In the light source unit 73, as drawn in FIG. 2B, the opaque slit board 75 is located between the second light source 74 and the irradiation area $P_0$ so as to obstruct the optical path of the light $L_2$. FIG. 3 illustrates an example of the slit board 75 in the frame A enclosed by dash line, and the slit board 75 is a plate-like member located to be substantially parallel to the YZ plane and to extend in the Y-direction. The slit board 75 has i slits $SL_1$ through $SL_i$ (which may be collectively referred to as slits SL), where i is a natural number equal to or more than one. When viewed from the sheet feeding direction, the slits SL have the same shapes with one another, and each of the slits SL is in the shape of a parallelogram inclined from the Z-axis. The slits SL are aligned in the main-scanning direction at uniform intervals. Because of the presence of the slit board 75, the light $L_2$ passes through the slits $SL_1$ through $SL_i$, and the light $L_2$ that passed through the slits $SL_1$ through $SL_i$ reaches the irradiation area $P_0$. In this regard, since each of the slits SL is in the shape of a parallelogram as described above, the light $L_2$ after passing through the slits SL has quantities of light varying according to positions in the main-scanning direction and according to positions in a direction normal to the irradiation area $P_0$ set on the sheet feed surface.

Again referring to FIGS. 2A and 2B, the sheet Sh passing through the sheet guide 71 is irradiated with the linear light $L_1$ and $L_2$, and the linear light $L_1$ and $L_2$ are then diffused in various directions. The diffused light includes main diffused light $L_3$ and $L_4$ traveling from the irradiation area $P_0$ in substantially a specified diffusing direction (that is, Z-direction). In the focusing optical system 76, for example, a first, a second and a third mirror, and a lens are arranged in this order from an upstream side to a downstream side along optical paths of the light $L_3$ and the light $L_4$ so as to be in fixed positions relative to the irradiation area $P_0$. More specifically, the axes of the first through third mirrors and the lens are set such that the light $L_3$ can be focused on the light-receiving section 77.

Figure 4:
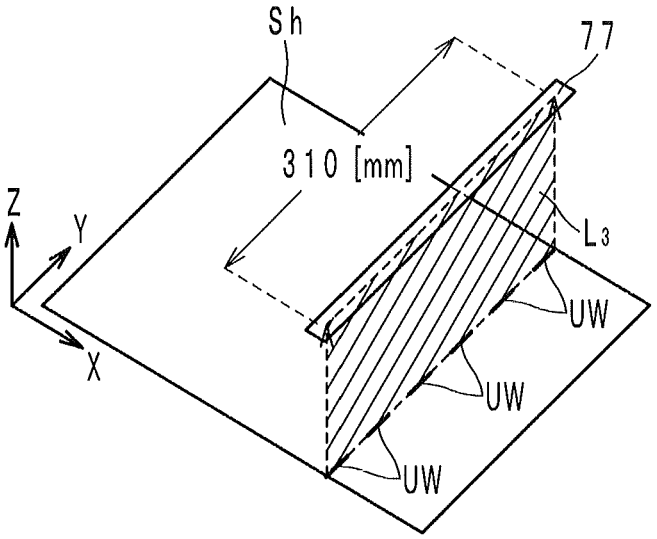
FIG. 4 is a diagram illustrating the specifications of a light-receiving section shown in FIG. 2A.

The light-receiving section 77 is an inline sensor having photoelectric conversion elements linearly arranged in the main-scanning direction, for example, a CCD (charge coupled device). Exemplary specifications of the light-receiving section 77 are as indicated in FIG. 4 and as described below.

Length in the main-scanning direction: 310 [mm]

Reading resolution: 600 [dpi]

Number of pixels: 1024 pixels per unit detection area

Unit detection width UW: approximately 43 [mm] in the main-scanning direction

The unit detection width UW means a width (size in the main-scanning direction) of a portion for which data, out of the data obtained by one-time scanning, is used for detection of curl. For example, for detection of curl in both end portions of a sheet, data for both end portions, each having the unit detection width UW (i.e., 1024 pixels), are used.

During the image quality test, at every scanning cycle, the light-receiving section 77 generates the first analog information representing the colors of a main-scanning line of the test sheet Sh passing through the guide 71 and outputs the first analog information to the signal processing circuit 8. During the detection of curl, at every scanning cycle, the light-receiving section 77 generates the second analog information representing quantities of received light for a main-scanning line of the sheet Sh passing through the guide 71 and outputs the second analog information to the signal processing circuit 8. The light-receiving section 77 may be a monochromatic sensor or alternatively a color sensor, for example, an RGB sensor. When an RGB color sensor is used as the light-receiving section 55, the density values with respect to the colors R, G and B may be converted into density values with respect to the colors Y, M C and Bk by the subsequent signal processing circuit 8 or the like.

Principle of Detection of Curl

Figure 5A:
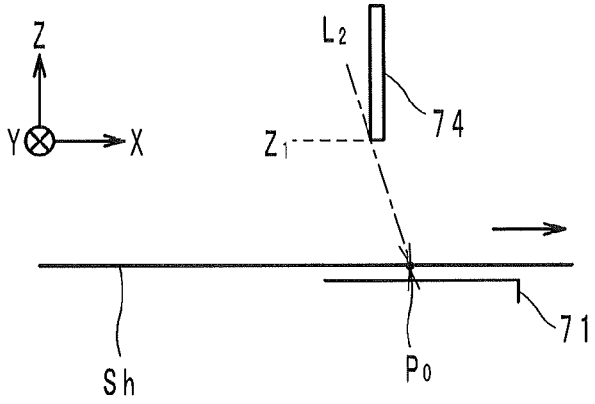
FIG. 5A is a diagram illustrating a state where a non-curled sheet passes over a guide.
Figure 5B:
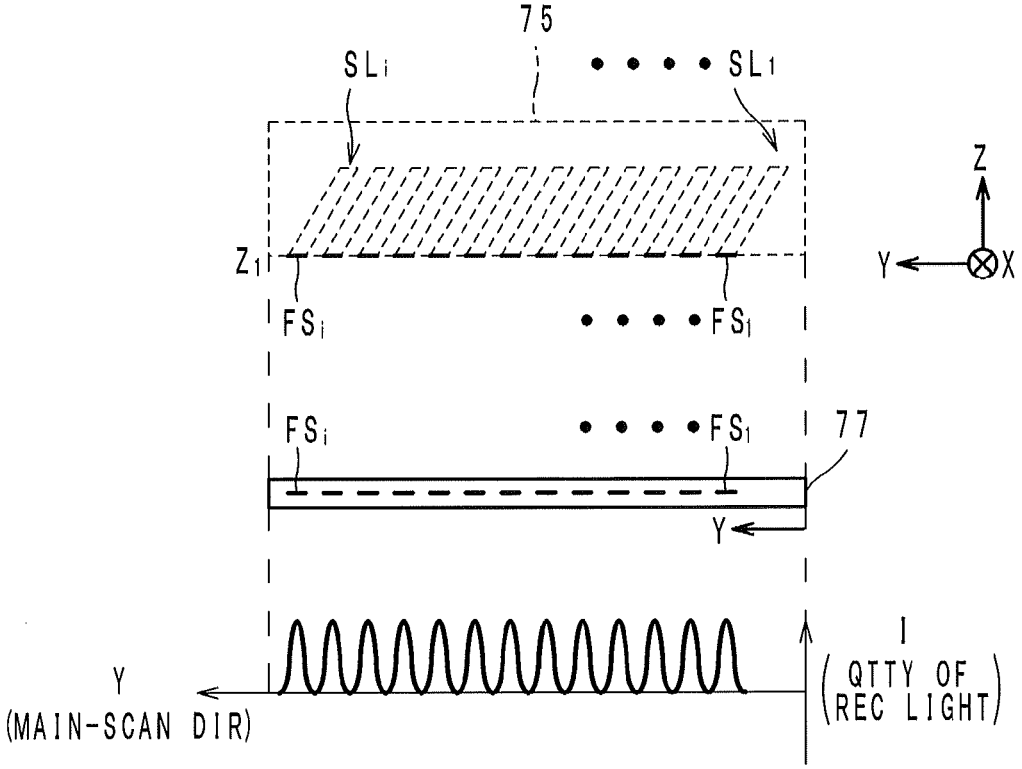
FIG. 5B is a diagram illustrating a process of generating second analog information when a non-curled sheet is passing.

Next, the principle of detection of curl is described. In the sensor section 7, the sheet Sh passes through the sheet feed surface of the guide 71 as drawn by FIG. 5A. In this moment, if the sheet Sh is not curled, the sheet Sh, on the whole, passes on through the irradiation area $P_0$. During the passing of the sheet Sh, as drawn by the uppermost section of FIG. 5B, the irradiation area $P_0$ is irradiated with rays of light included in the second light $L_2$ and traveling in a specified optical path. In this regard, the specified optical path extends from the light source 74 to the irradiation area $P_0$ through the respective portions of the slits SL at a position $Z_1$ in the Z-direction. In the following description, sections of a line of $Z=Z_1$ on the YZ plane and enclosed by the outlines of the parallelogram slits $SL_1$ through $SL_i$ are referred to as first sections $FS_1$ through $FS_i$.

The light $L_2$ passing through the slit board 75 is diffused at the irradiation area $P_0$, and only the main diffused light $L_4$ travels in the Z-direction. The light $L_4$ enters the focusing optical system 76 and is focused on the light-receiving section 77. Then, as drawn in the middle section of FIG. 5B, the light $L_4$ has large quantities of light in the sections $FS_1$ through $FS_i$ compared with other sections. The second analog information output from the light-receiving section 77 has the same characteristic as the light $L_4$ focused on the light-receiving section 77 (see the lowermost section of FIG. 5B).

Figure 6A:
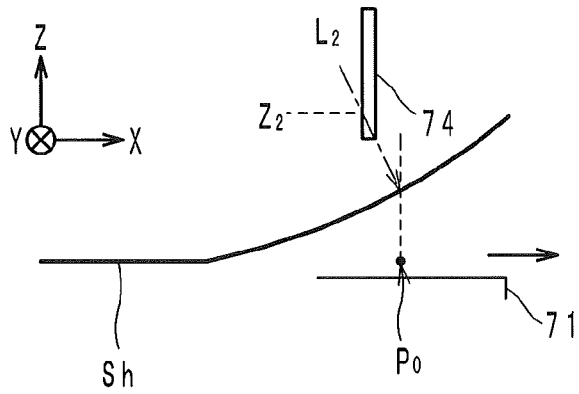
FIG. 6A is a diagram illustrating a state where a curled sheet passes over a guide.
Figure 6B:
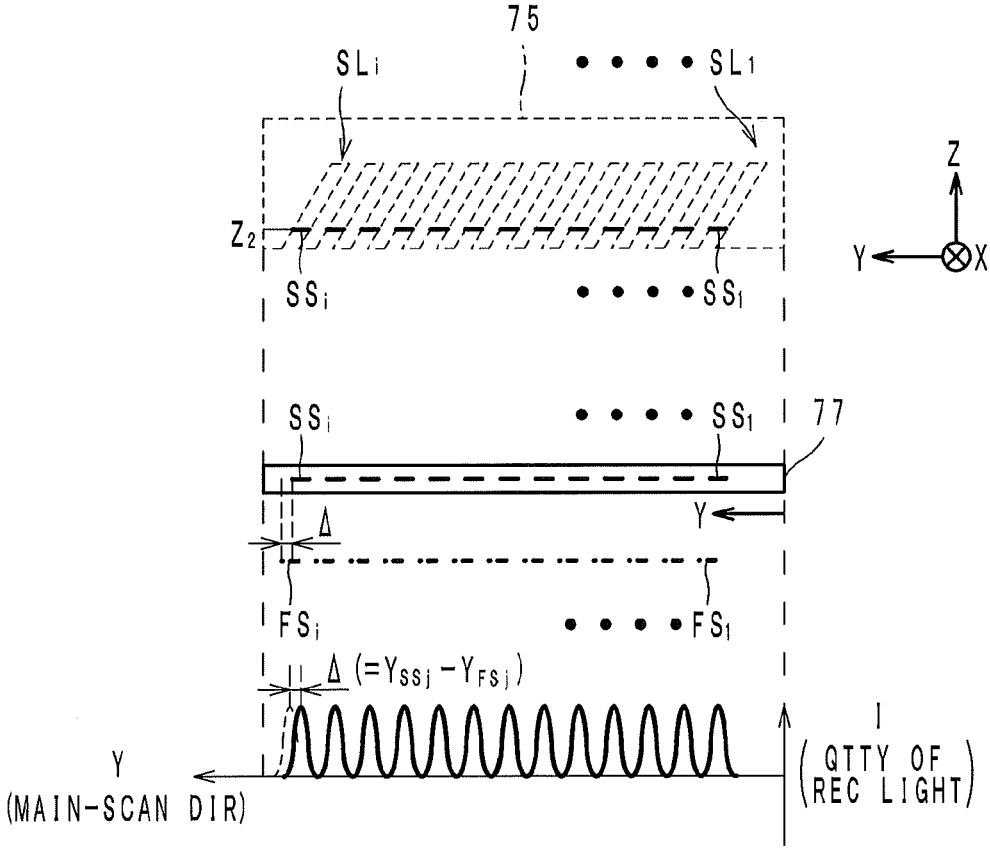
FIG. 6B is a diagram illustrating a process of generating second analog information when a curled sheet is passing.

Next, a case where the sheet Sh passing through the sensor section 7 is curled is described. In this case, the curled portion of the sheet Sh is not parallel to the XY plane and passes above the irradiation area $P_0$. As drawn by the uppermost section of FIG. 6B, the line of intersection of the curled portion and a plane parallel to the YZ plane and including the irradiation area $P_0$ is irradiated with rays of light included in the second light $L_2$ and traveling in a certain optical path. If the sheet Sh is curled, the certain optical path extends from the light source 74 to the line of intersection through the respective portions of the slits SL at a position $Z_2$ ($Z_2 \neq Z_1$) in the Z-direction. Sections of a line $Z=Z_2$ on the YZ plane and enclosed by the outlines of the parallelogram slits $SL_1$ through $SL_i$ are referred to as second sections $SS_1$ through $SS_i$.

The light $L_2$ passing through the slit board 75 is diffused at the curled portion and is focused on the light-receiving section 77 through the focusing optical system 76. The light-receiving section 77 carries out photoelectric conversion of the light $L_4$ to generate analog information. In this moment, as drawn by the middle section of FIG. 6B, what is focused on the light-receiving section 77 is the light $L_4$ having large quantities of light in the sections $SS_1$ through $SS_i$, and the quantities of light vary cyclically according to positions in the main-scanning direction. The position of the section $SS_1$ is shifted from the position of the section $FS_1$ in the main-scanning direction by an amount Δ correlating with an amount of $Z_2$ minus $Z_1$. The same applies to the positional relations between the sections $SS_2$ through $SS_i$ and the sections $FS_2$ through $FS_i$. Also, as mentioned above, the light $L_2$ after passing through the slit board 75 has quantities of light varying according to positions in a direction normal to the irradiation area $P_0$ set on the sheet feed surface, and therefore, the quantities of light in the sections $SS_1$ through $SS_i$ are different from the quantities of light in the sections $FS_1$ through $FS_i$. As the light $L_4$ focused on the light-receiving section 77, the second analog information varies cyclically according to positions in the main-scanning direction and represents large quantities of light in the sections $SS_1$ through $SS_i$ (see the lowermost section of FIG. 6B). In this regard, the time waveform of the analog information in a case of occurrence of curl is shifted in the main-scanning direction by an amount Δ, compared with the time waveform of the analog information in a case of non-occurrence of curl.

When the amount of curl Ac is defined as a distance in the Z-direction between the irradiation area $P_0$ and the sheet Sh, the amount of curl Ac is substantially proportional to the amount Δ. Accordingly, the amount of curl Ac is calculated as follows.

$$Ac=\alpha\times\Delta \tag{1}$$

In the expression (1), α is a proportional constant and is determined from the specifications of the sensor section 7. Accordingly, α is a known value, which is, for example, a value calculated before the shipment of the image forming apparatus 1 from the factory. The value Δ is a difference between the sections $SS_1$ through $SS_i$ and the corresponding sections $FS_1$ through $FS_i$.

The positions in the main-scanning direction where peak quantity values of received light appear in the respective sections $SS_1$ through $SS_i$ are referred to as $Y_{SS1}$ through $Y_{SSi}$ respectively, and the positions in the main-scanning direction where peak quantity values of received light appear in the respective sections $FS_1$ through $FS_i$ are referred to as $Y_{FS1}$ through $Y_{FSi}$ respectively. Then, the value Δ is calculated by $Y_{SSj}-Y_{FSj}$ (j is a natural number not less than one and not more than i). Accordingly, the expression above (1) can be rewritten as follows.

$$Ac=\alpha\times(Y_{SSj}-Y_{FSj}) \tag{2}$$

The value $Y_{FSj}$ is a value determined based on $Z_1$, and accordingly, the value $Y_{FSj}$ is a known value, which is, for example, a value calculated before the shipment of the image forming apparatus 1 from the factory. The $Y_{SSj}$ is a value depending on the state of the sheet Sh, and accordingly, the $Y_{SSj}$ is an unknown value. Thus, by detecting the position $Y_{SSj}$ in the main-scanning direction with regard to the sheet Sh passing through the guide 71, the amount of curl Ac of the sheet Sh can be derived.

Curl Detection Process

Figure 7:
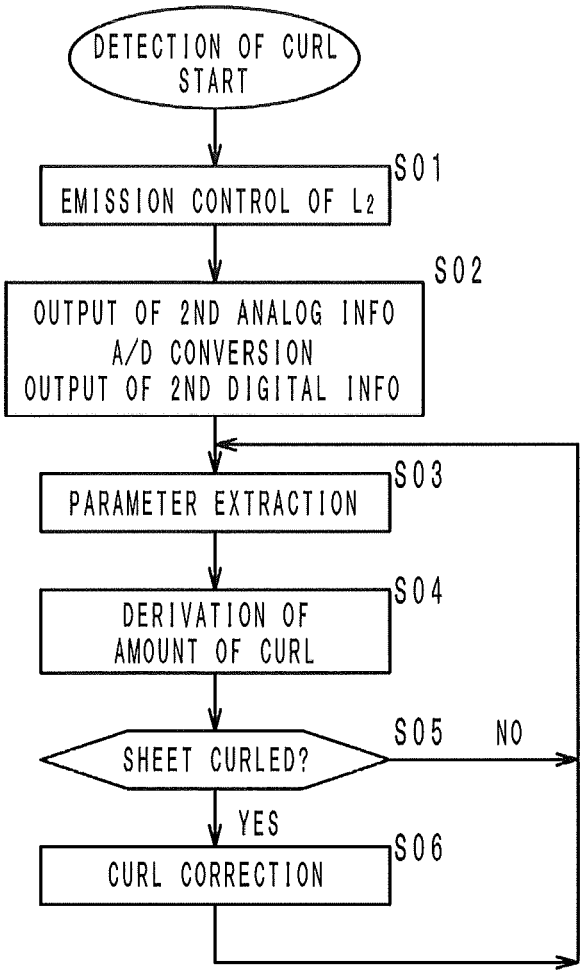
FIG. 7 is a flowchart representing a curl detection process carried out by a control circuit.

Next, referring to FIG. 7, a curl detection process is described in detail. During a printing operation, the control circuit 9 keeps the first light source 72 turned off and makes the second light source 74 emit the light $L_2$ (S01 in FIG. 7). In an exemplary curl detection process hereinafter described, the first light source 72 is kept turned off. However, the first light source 72 may be turned on.

While the sheet Sh is passing through the guide 71, at every scanning cycle, the light-receiving section 77 outputs the second analog information, and the signal processing circuit 8 converts the second analog information into second digital information and outputs the second digital information to the control circuit 9 (S02 in FIG. 7).

On receiving the second digital information, the control circuit 9 carries out parameter extraction from the received-light quantity values with respect to a portion with the unit detection width UW (S03 in FIG. 7).

In the following, the parameter extraction is described with reference to FIG. 8. The upper section of FIG. 8 illustrates a parameter extraction process when the sheet Sh is not curled, and the lower section of FIG. 8 illustrates a parameter extraction process when the sheet Sh is curled.

Figure 8:
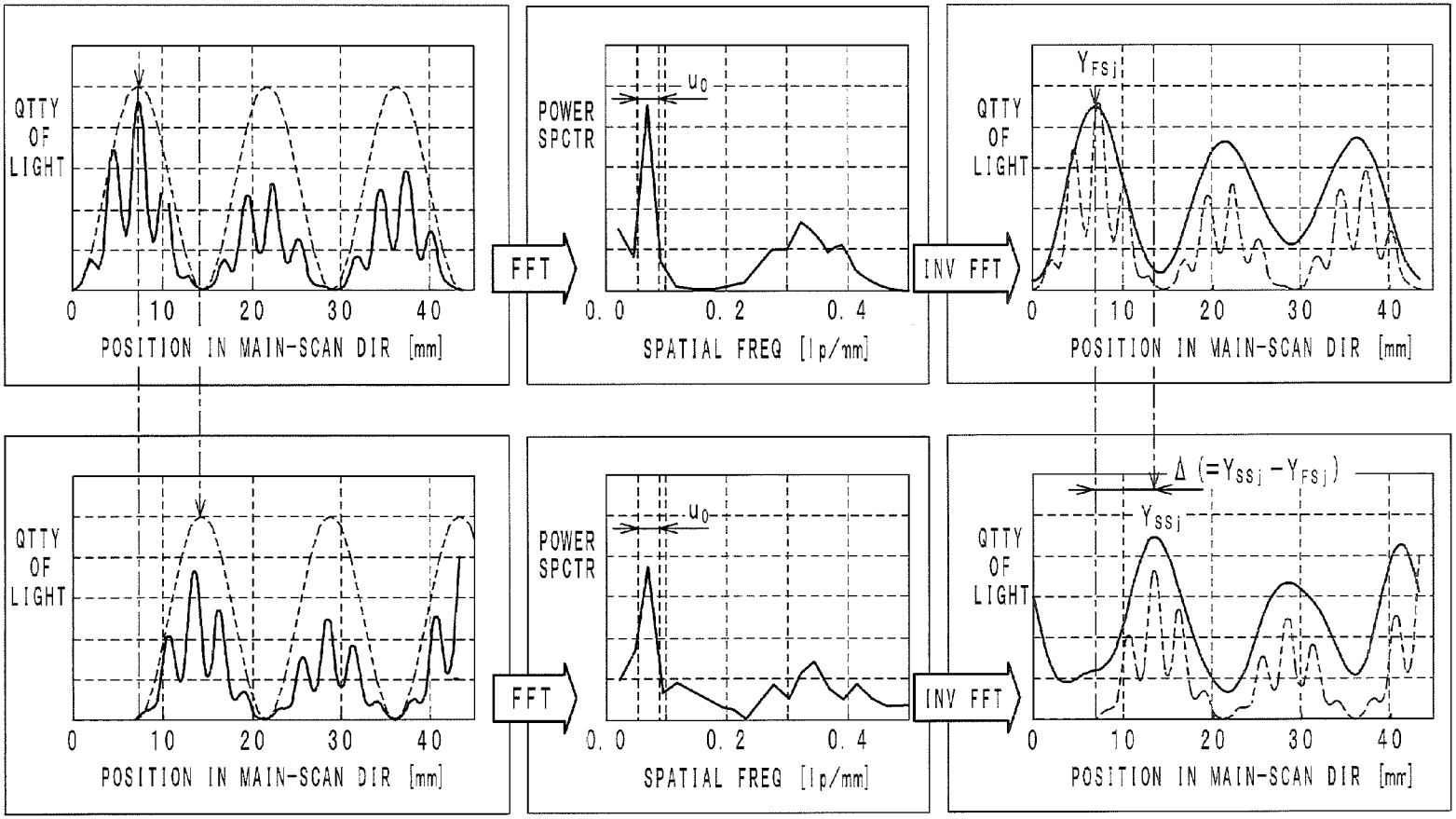
FIG. 8 is a diagram illustrating a parameter extraction process.
Figure 9:
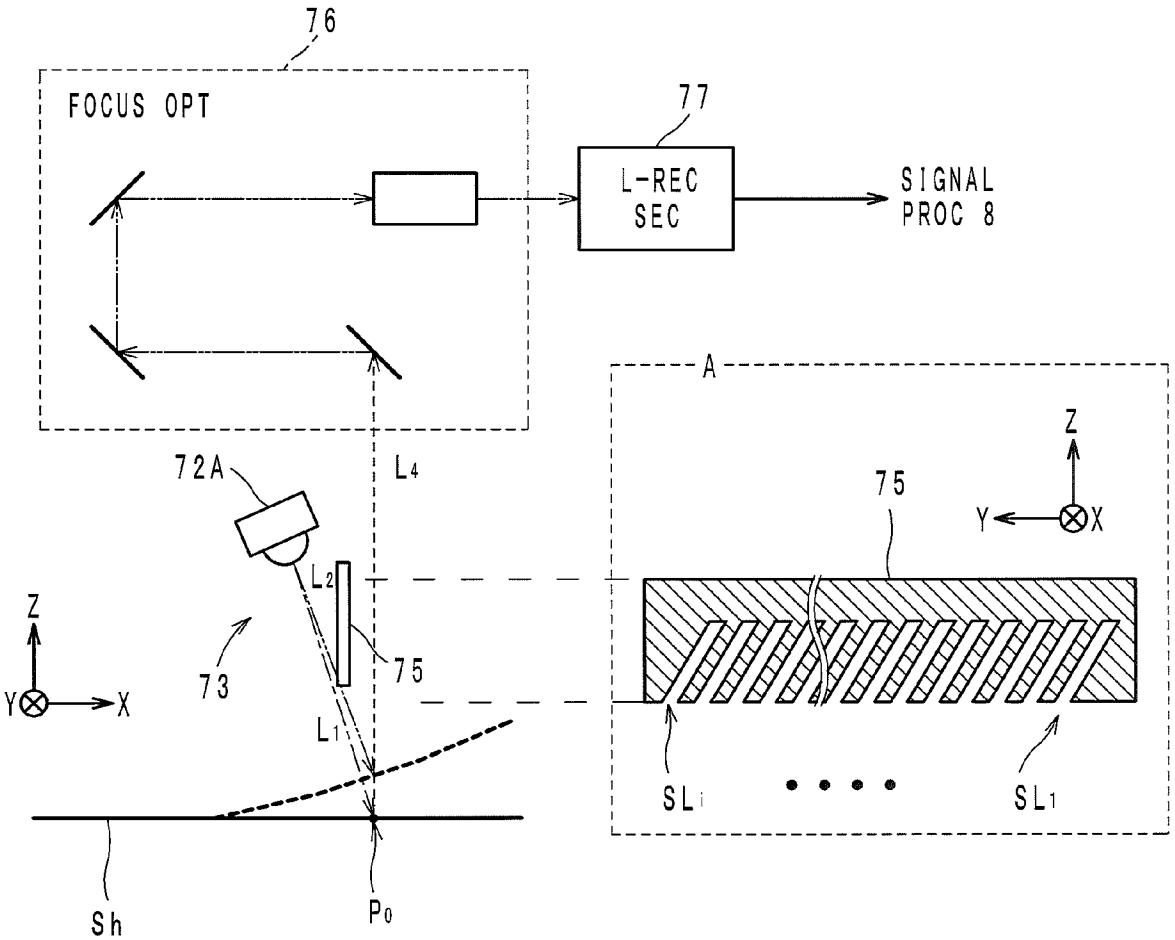
FIG. 9 is a diagram illustrating another structural example of the sensor section shown in FIG. 1.

In the graph in the upper left part of FIG. 8, the received-light quantity values (analog values) in a portion with the unit detection width UW (approximately 43 mm in this embodiment) are illustrated by a solid line. In the graph in the upper left part of FIG. 8, for the purpose of reference, the quantities of light with which the irradiation area $P_0$ is irradiated are illustrated by a dash line.

The control circuit 9 carries out Fourier transform of the received-light quantity values for a portion with the unit detection width UW. The Fourier transform is, for example, FFT (fast Fourier transform). As a result of the Fourier transform, as represented by the graph in the upper middle part of FIG. 8, the control circuit 9 obtains power spectrum relative to spatial frequency. Thereafter, the control circuit 9 extracts power spectrum within a predetermined low spatial frequency bandwidth $u_0$, which correlates with the intervals among the slits SL made in the slit plate 75, and carries out inverse Fourier transform of the extracted power spectrum. As a result of the inverse Fourier transform, as illustrated in the graph in the upper right part of FIG. 8, the control circuit 9 obtains an envelope waveform of the power spectrum illustrated in the graph in the upper middle part of FIG. 8. In the envelope waveform, quantity of light is represented relative to positions in the main-scanning direction. Then, the control circuit 9 extracts, as an example of parameters correlating with the amount of curl, a position $Y_{SSj}$ in the main-scanning direction where a peak value appears from the envelope wave (S03 in FIG. 7).

The graphs in the lower left part through the lower right part of FIG. 8 illustrate a parameter extraction process in a case of occurrence of curl. The parameter extraction process is the same regardless of whether or not the sheet is curled, and a description of the parameter extraction process here is omitted. By this parameter extraction process, the control circuit 9 obtains a position $Y_{SSj}$ in the main-scanning direction shifted by Δ compared with a case of non-occurrence of curl.

Next, the control circuit 9 substitutes the position $Y_{SSj}$ extracted at step S03 in the expression (2) to derive the amount of curl Ac (S04 in FIG. 7). As mentioned above, if the sheet Sh is not curled, $Y_{SSj}$ is equal to $Y_{FSj}$, and accordingly, the amount of curl Ac is derived to be zero.

Next, the control circuit 9 determines whether or not the sheet Sh currently passing through the sensor section 7 is curled, based on the amount of curl Ac derived at step S04 (S05 in FIG. 7). If the control circuit 9 determines that curl does not occur, the control circuit 9 carries out the steps S03 through S05 on the next portion with the unit detection width UW.

On the other hand, if the control circuit 9 determines that curl occurs, the control circuit 9 sends the derived amount of curl Ac to the curl correcting section 6 and controls the curl correcting section 6 so as to perform curl correction on the sheet fed thereto (S06 in FIG. 7). Specifically, if the derived amount of curl Ac is zero or small, the curl correcting section 6 does not perform curl correction. On the other hand, if the derived amount of curl Ac is large, the curl correcting section 6 performs curl correction. On completion of the step S06, the control circuit 9 carries out step S03 and the subsequent steps on the next portion with the unit detection width UW.

Operation and Effects

As mentioned above, the image forming apparatus 1 carries out image quality stabilization control and the like at a time other than printing operation. For this purpose, the sensor section 7 is provided in the image forming apparatus 1, in the vicinity of the sheet path FP, downstream from the fixing section 5. Also, the image forming apparatus 1 derives an amount of curl of sheets during a printing operation by making efficient use of the sensor section 7 in the above-described way. Thus, in the image forming apparatus 1, the sensor section 7 is used for more than one purpose, namely, for image quality stabilization control and for derivation of curl of sheets. Accordingly, it is no longer necessary to provide a two-dimensional area sensor or the like in the image forming apparatus 1 only for the purpose of deriving an amount of curl of sheets. Thus, it is possible to derive an amount of curl of sheets at low cost without causing an increase in the size of the image forming apparatus 1.

Notes

In the embodiment above, the sensor section 7 includes a first light source 72 used for image quality tests, and a second light source 74 used for detection of curl. However, the first and second light sources 72 and 74 may be replaced with only one light source 72A. In this case, a part of light emitted from the light source 72A that passes through the slits SL is used for detection of curl, and a part of light emitted from the light source 72A that passes under the slit board 75 is used for image quality tests.

First Modification

In the embodiment above, the light source unit 73 comprises the slit board 75. However, the light source unit 73 may comprise a slit board 75A according to a first modification instead of the slit board 75. In the following, the slit board 75A is described with reference to FIGS. 10A and 10B.

Figure 10A:
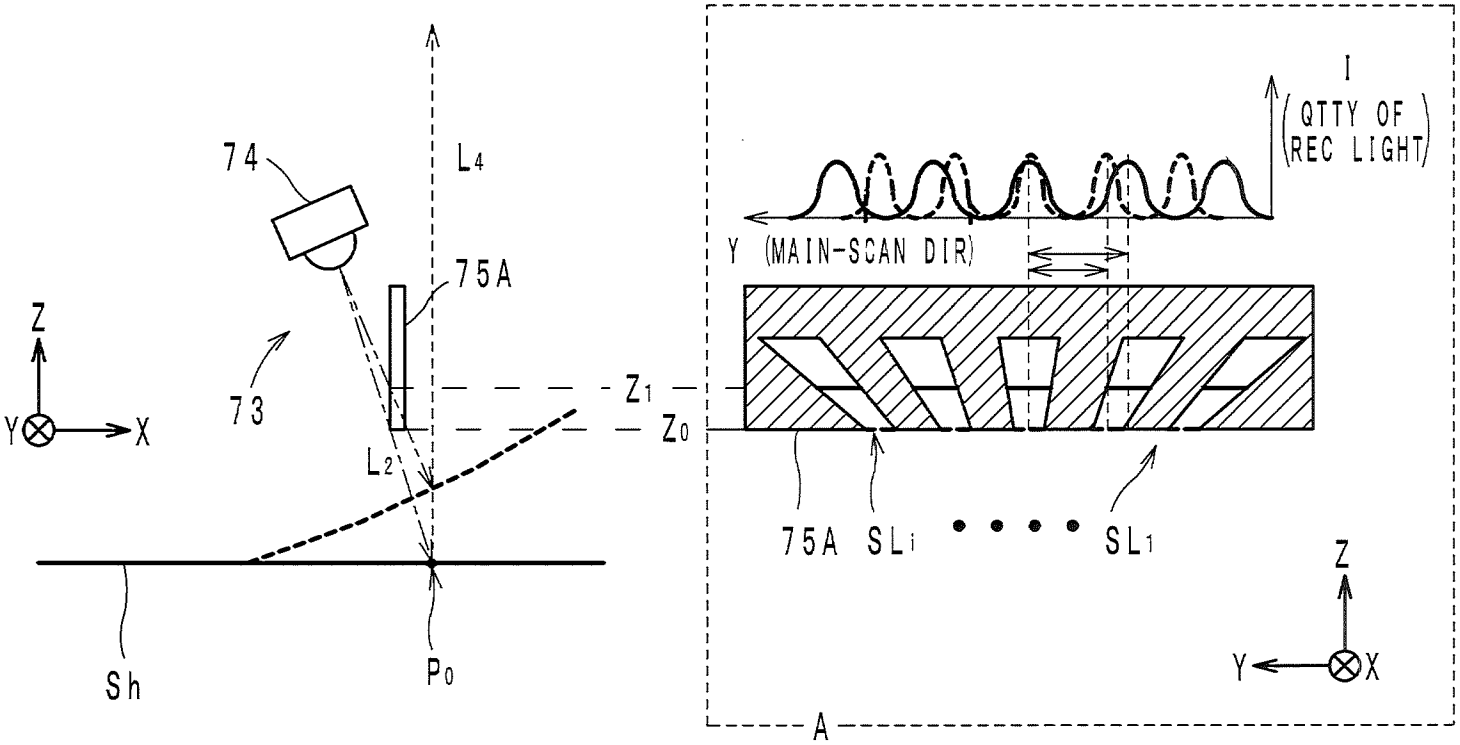
FIG. 10A is a diagram illustrating a slit board according to a first modification.

When viewed from the sheet feeding direction, as drawn in the frame A of FIG. 10A, the slit board 75A has slits $SL_1$ through $SL_i$ (i is an integer equal to or more than two) aligned in the main-scanning direction at predetermined intervals. The distance between the centers of two adjacent slits SL in the main-scanning direction varies according to positions in the diffusing direction.

Figure 10B:
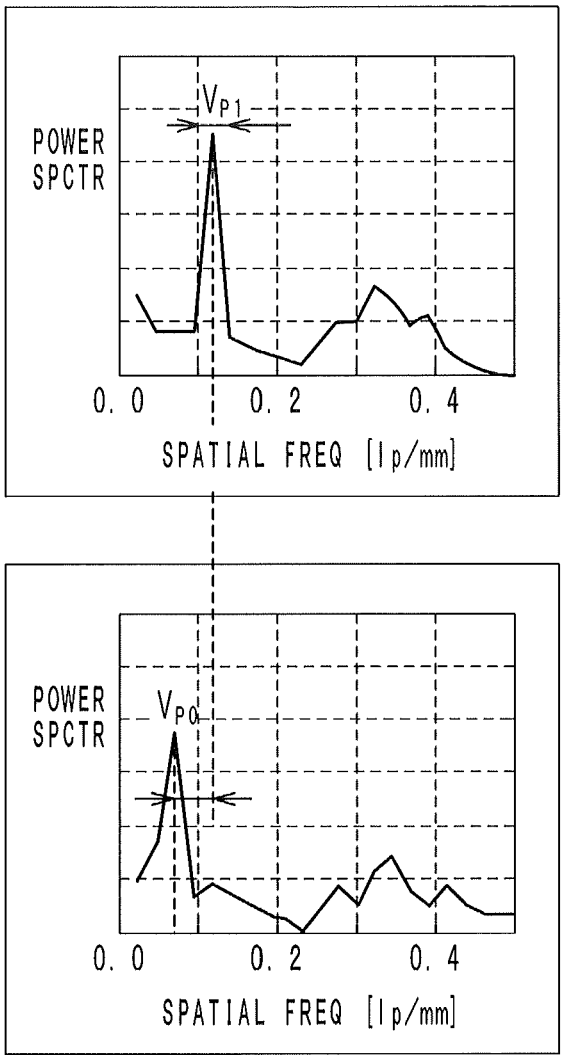
FIG. 10B is a diagram illustrating a parameter extraction process according to the first modification.

With these slits $SL_1$ through $SL_i$, as drawn in FIG. 10A, the light quantity values indicated by the second analog information vary cyclically according to positions in the main-scanning direction, and the cycle length depends on the position in the diffusing direction, that is, the position in the direction normal to the irradiation area $P_0$ set on the sheet feed surface, and further in other words, depends on the amount of curl. In FIG. 10A, positions $Z_0$ and $Z_1$ are drawn as examples of the positions in the diffusing direction. In the graph above the illustration of the slit board 75A, the dash line represents the second analog information when the position in the diffusing direction is $Z_0$, and the solid line represents the second analog information when the position in the diffusing direction is $Z_1$. The control circuit 9 carries out parameter extraction from the second analog information in the following manner. Specifically, the control circuit 9 carries out Fourier transform of the received-light quantity values on a portion with the unit detection width UW, thereby obtaining power spectrum, as illustrated in FIG. 10B, relative to spatial frequency. Then, a peak value $V_P$ is detected on a position on the spatial frequency axis, and the position correlates with the amount of curl Ac. In FIG. 10B, a peak value $V_{P0}$ is illustrated as the peak value $V_P$ in a case of non-occurrence of curl, and a peak value $V_{P1}$ is illustrated as the peak value $V_P$ in a case of occurrence of curl.

In this regard, before the shipment of the image forming apparatus 1 from the factory, the amounts of curl Ac relative to positions (more specifically, positions on the spatial frequency axis) of peak values $V_P$ are collected from an experiment or the like. Based on the collected data, a table representing the amounts of curl Ac relative to positions of peak values $V_P$ is prepared and stored in the control circuit 9. The control circuit 9 reads the amount of curl Ac matching the obtained position of the peak value $V_P$ from the table.

Operation and Effects

In the embodiment above, the light quantity values included in the analog information output from the sensor section 77 are also affected by the toner image formed on the sheet Sh and other factors. Therefore, the light quantity values do not always vary cyclically according to positions in the main-scanning direction and have high-frequency components (see, for example, the graphs in the upper left part and the upper middle part of FIG. 8). Because of the high-frequency components, there is possibility that the control circuit 9 may make errors in detecting the peak values in the sections $SS_1$ through $SS_i$.

In the first modification, on the other hand, the amount of curl Ac is derived from the position of the peak value $V_P$ on the spatial frequency axis, and it is possible to significantly diminish the effect of the high-frequency components included in the analog information on the detection of curl.

Second Modification

Further, the light source unit 73 may comprise a slit board 75B according to a second modification instead of the slit board 75. In the following, the slit board 75B is described with reference to FIGS. 11A and 11B.

When viewed from the sheet feeding direction, the lower side of the slit board 75B is saw-toothed, and specifically, notches $N_1$ through $N_i$ is an integer equal to or more than one) are arranged continuously in the main-scanning direction. In this modification, the width (size in the main-scanning direction) of each of the notches $N_1$ through $N_i$ decreases with progress in the positive diffusing direction. Each of the notches $N_1$ through $N_i$ has a symmetrical shape with respect to the center in the main-scanning direction.

Figure 11A:
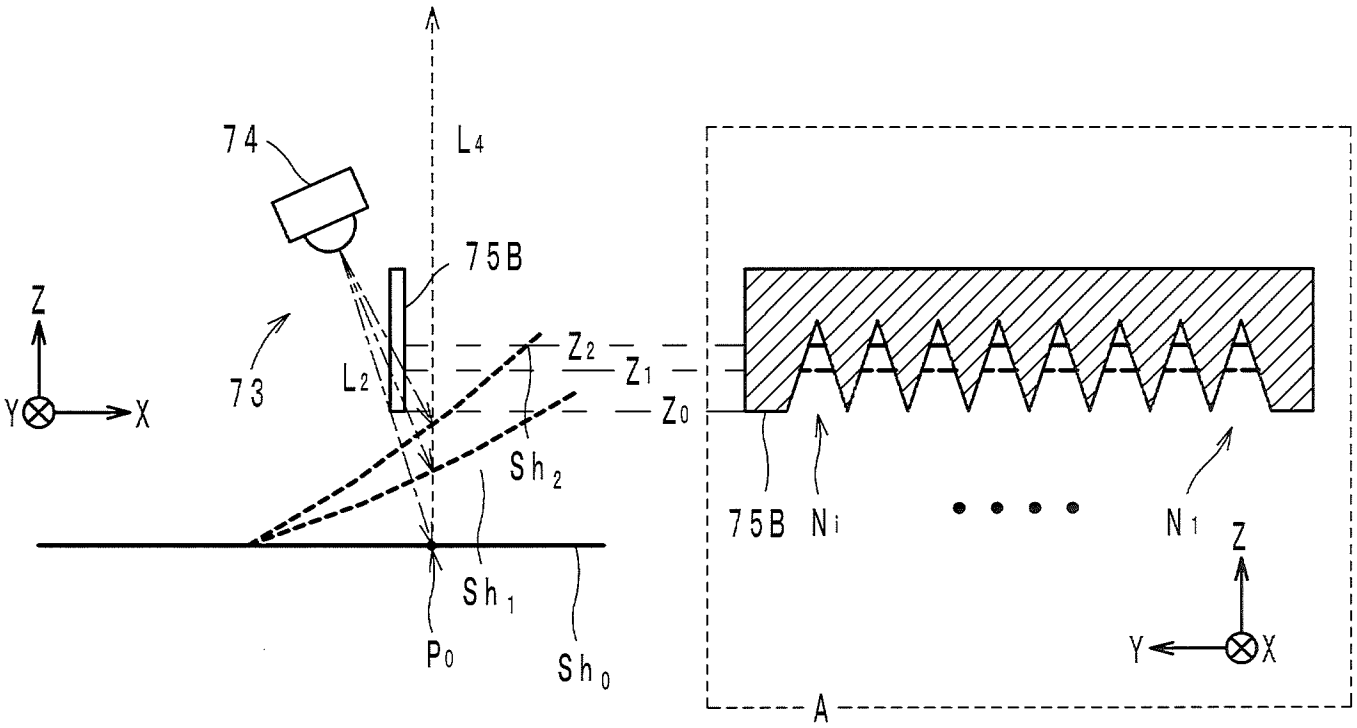
FIG. 11A is a diagram illustrating a detailed structure of a slit board according to a second modification.

The slit board 75B is positioned as drawn in FIG. 11A to meet the following conditions (1) through (3).

(1) A non-curled sheet $Sh_0$ is irradiated at the irradiation area $P_0$ with a part of the light $L_2$ emitted from the light source 74 that passes under the slit board 75B (for example, passing through the position $Z_0$ in the Z-direction).

(2) A slightly-curled sheet $Sh_1$ is irradiated at a position above the irradiation area $P_0$ with a part of the light $L_2$ emitted from the light source 74 that passes through a relatively lower portion of the notches $N_1$ through $N_i$ (for example, passing through the position $Z_1$ in the Z-direction).

(3) A greatly-curled sheet $Sh_2$ is irradiated at a position above the irradiation area $P_0$ with a part of the light $L_2$ emitted from the light source 74 that passes through a relatively upper portion of the notches $N_1$ through $N_i$ (for example, passing through the position $Z_2$ in the Z-direction).

Figure 11B:
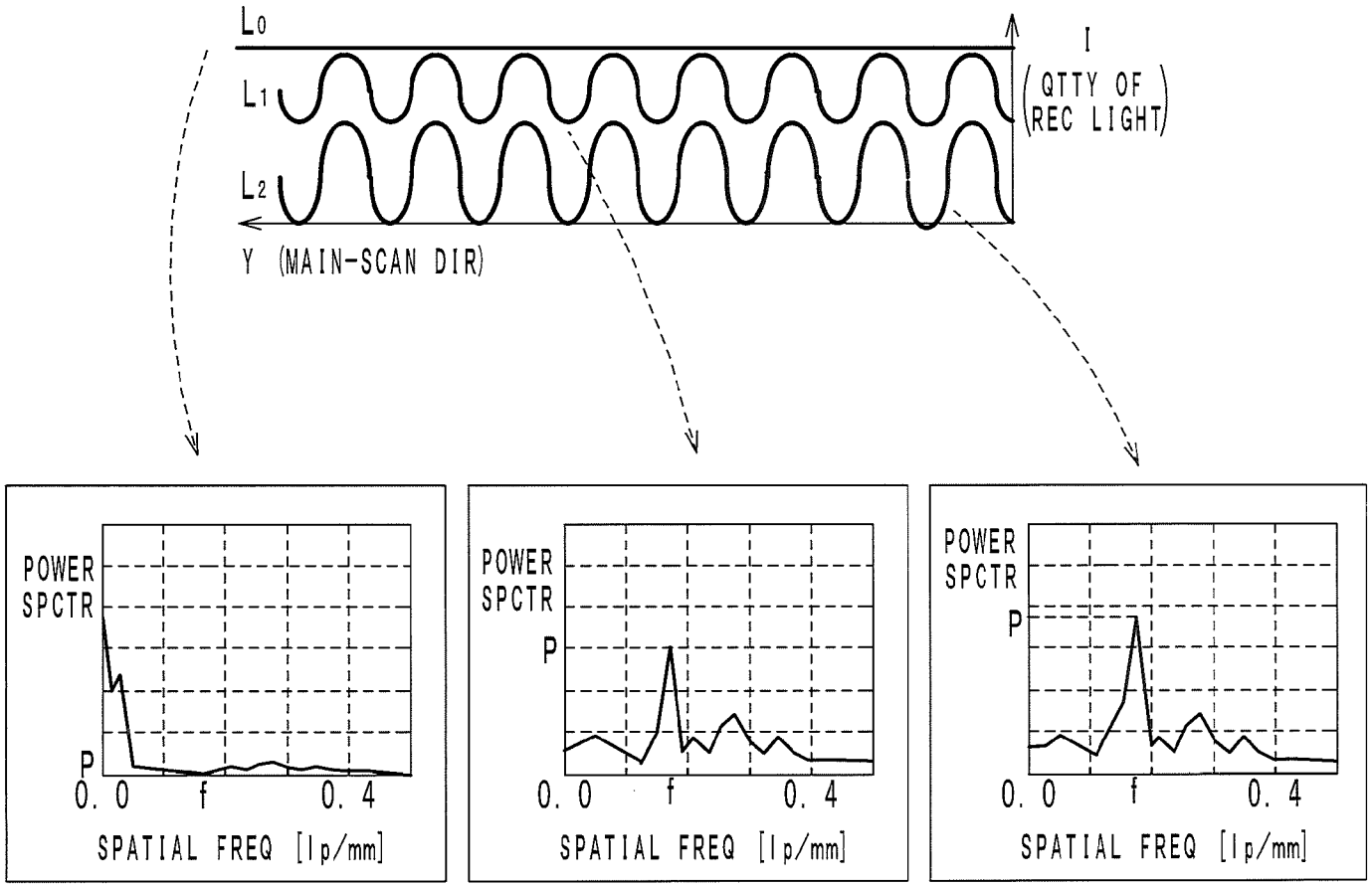
FIG. 11B is a diagram illustrating a parameter extraction process according to the second modification.

Because of the slit board 75B positioned above, as drawn in the upper part of FIG. 11B, in a case of non-occurrence of curl, the second analog signal represents that the light quantity values on positions in the main-scanning direction are constant (see straight line $L_0$). In a case of occurrence of curl, on the other hand, the second analog signal represents that the light quantity values vary cyclically according to positions in the main-scanning direction with substantially a constant cyclic length regardless of the amount of curl. In this regard, however, for example, when the amount of curl is small, the second analog information represents relatively large light quantity values (see curve $L_1$). When the amount of curl is large, the second analog information represents relatively small light quantity values (see curve $L_2$).

The control circuit 9 carries out parameter extraction on the second analog information in the following manner. Specifically, the control circuit 9 carries out Fourier transform of the received-light quantity values with respect to a portion with the unit detection width UW, thereby obtaining power spectrum, as illustrated in FIG. 11B, relative to spatial frequency. Then, the control circuit 9 detects the peak value that appeared at a spatial frequency f, which is predetermined in accordance with the slit board 75B. In this regard, the power P of the peak correlates with the amount of curl. As illustrated in the graph in the lower left part of FIG. 11B, when the sheet is not curled, the power P at the spatial frequency f is zero. As illustrated in the graph in the lower middle part of FIG. 11B, if the sheet is slightly curled, the power P at the spatial frequency f is relatively small. As illustrated in the graph in the lower right part of FIG. 11B, if the sheet is greatly curled, the power P at the spatial frequency f is relatively large. Although the reflected-light quantities are affected by the kind of sheet and the printing condition as well as the spatial frequency f, the frequency analysis above can eliminates the effects of the kind of sheet and the printing condition. Therefore, the occurrence or non-occurrence of curl and the amount of curl can be evaluated accurately.

Third Modification

In the embodiment above, the image forming apparatus 1 comprises the light source unit 73. However, the image forming apparatus 1 may comprise a light source unit 73A according to a third modification instead of the light source unit 73. In the following, the light source unit 73A is described with reference to FIG. 12.

Figure 12:
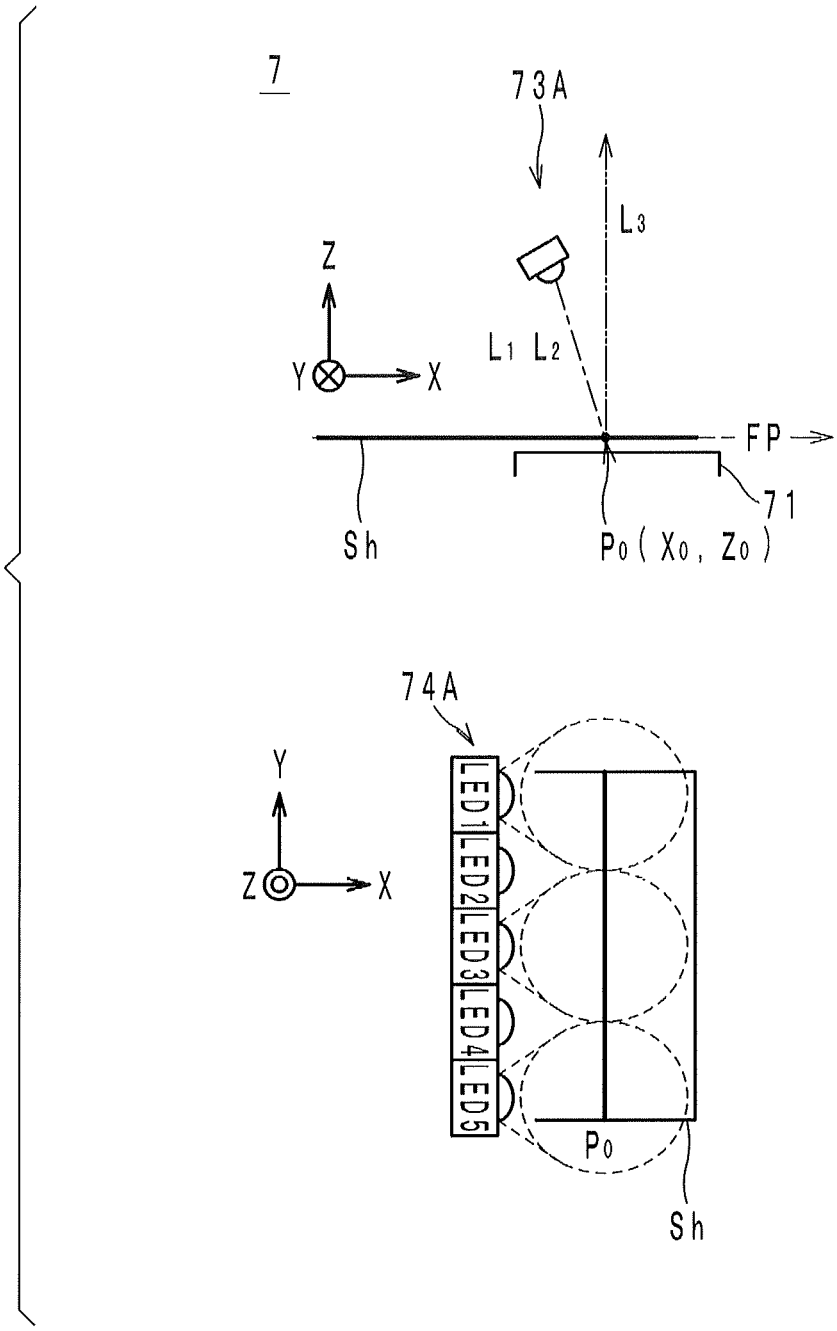
FIG. 12 is a diagram illustrating a detailed structure of a light source unit according to a third modification.

As illustrated in FIG. 12, the light source unit 73A is different from the light source unit 73 in that the light source unit 73A has a second light source 74A instead of the second light, source 74 and does not have the slit board 75.

The second light source 74A is, for example, an LED array including LEDs linearly arranged in the main-scanning direction. Under the control of the control circuit 9, the second light source 74A, at the time of detection of curl, generates and emits a second linear beam of light $L_2$ of which quantities of light on the irradiation area $P_0$ vary cyclically according to positions in the main-scanning direction and of which quantities of light on different positions in the height direction (the Z-direction) are different. An exemplary way of generating the linear beam of light $L_2$ is as follows. As illustrated in FIG. 12, the LED array 12 is arranged so as to irradiate the irradiation area $P_0$ diagonally, and the control circuit 9 controls the LED array 12 such that only the odd LEDs of the LEDs linearly arranged in the main-scanning direction are allowed to emit light while the even LEDs are prevented from emitting light.

The light source 74A can be used not only for detection of curl but also for image quality tests. For an image quality test, the control circuit 9 makes all of the LEDs to emit light so that the second light source 74A can emit light similar to the first linear beam of light $L_1$. In this structure, it is possible to omit the first light source 72, and it becomes possible to further reduce the cost and the size of the image forming apparatus 1.

Fourth Modification

Figure 13:
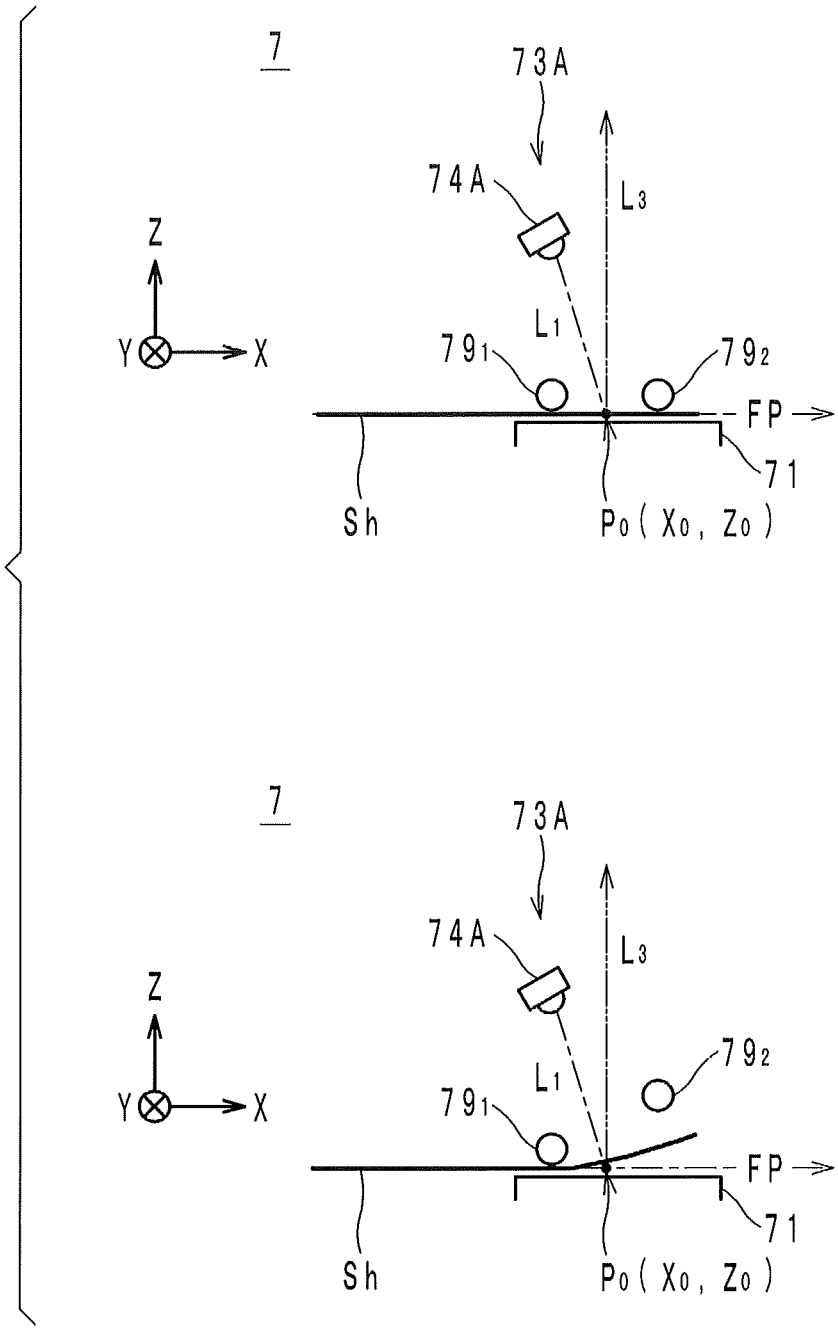
FIG. 13 is a diagram illustrating a detailed structure of an inline sensor section according to a fourth modification.

For an image quality test of a toner image formed on a sheet Sh by use of the sensor section 7, it is desired that the sheet Sh is positioned on the guide 71 as in parallel as possible to the XY plane. To this end, as illustrated in FIG. 13, the sensor section 7 comprises, in the sheet path FP, on the guide 71, an upstream pressing roller $\mathbf{79}_1$ and a downstream pressing roller $\mathbf{79}_2$ at positions respectively upstream and downstream from the irradiation area $P_0$.

By making the sheet Sh pass between the rollers $\mathbf{79}_1$ and the guide 71 and between the roller $\mathbf{79}_2$ and the guide 71, it is possible to position the sheet Sh substantially in parallel to the XY plane at least in the irradiation area $P_0$, thereby allowing an accurate image quality test. In this regard, however, for accurate detection of sheet curl, one of the rollers $\mathbf{79}_1$ and $\mathbf{79}_2$ is retracted upward from the guide 71 during a printing operation.

Fifth Modification

Figure 14:
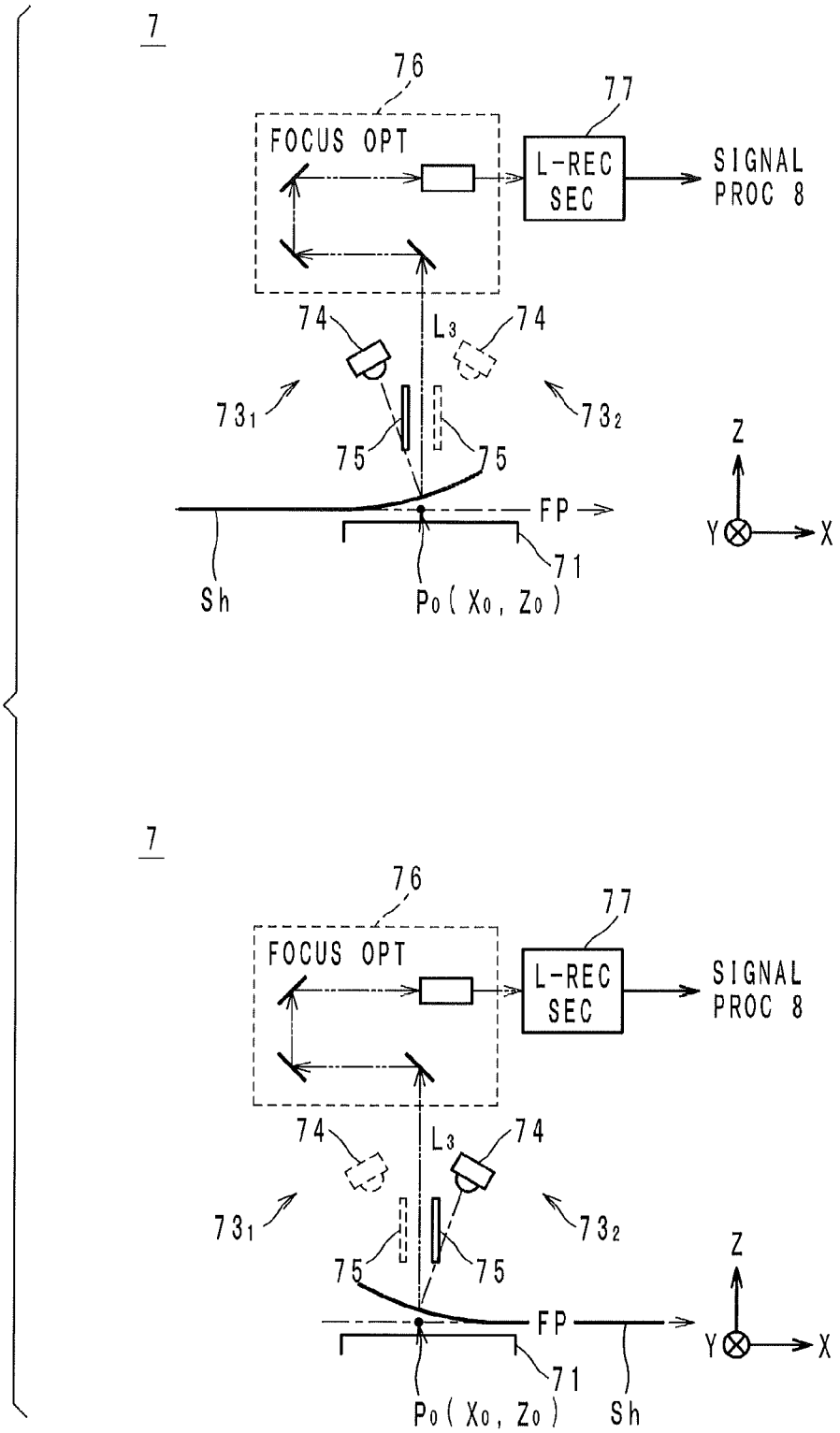
FIG. 14 is a diagram illustrating a detailed structure of an inline sensor section according to a fifth modification.

For accurate detection of curl, it is preferred that the peak light quantity values included in the second analog information are large. An exemplary way of obtaining large peak light quantity values is setting the incident angle of the second linear beam of light $L_2$ to the irradiation area $P_0$ as close as possible to zero. Specifically, as illustrated in FIG. 14, two light source units 73 are provided. More specifically, one of the two light source units $\mathbf{73}_1$ is located in the sheet path FP, upstream from the irradiation area $P_0$, and the other light source unit $\mathbf{73}_2$ is located in the sheet path FP, downstream from the irradiation area $P_0$. For detection of curl in the leading end portion of the sheet Sh, the downstream light source unit $\mathbf{73}_2$ is used, and for detection of curl in the trailing end portion of the sheet Sh, the upstream light source unit $\mathbf{73}_1$ is used.

Although the present invention has been described in connection with the preferred embodiments, it is to be noted that various changes and modifications are apparent to persons skilled in the art. Such changes and modifications are to be understood as being within the scope of the invention.

What is claimed is:

1. An image forming apparatus comprising:

an image forming section configured to form a toner image on a sheet;

a fixing section configured to fix the toner image formed by the image forming section on the sheet and to feed the sheet out therefrom; and a sensor section configured to read the toner image on the sheet fed from the fixing section;

wherein the sensor section includes:

a sheet path configured to lead the sheet fed from the fixing section to pass in a predetermined sheet feeding direction;

a light source unit configured to emit light toward an irradiation area preliminarily set in the sheet path, the light being elongated in a main-scanning direction different from the sheet feeding direction and having quantities of light varying according to positions in the main-scanning direction and according to positions in a height direction perpendicular to a sheet feed surface; and a light-receiving section configured to receive light diffused in a predetermined diffusing direction different from the sheet feeding direction and the main-scanning direction among the light emitted from the light source and then irradiated to the sheet passing in the sheet path, and to output information representing quantities of the received light; and wherein the image forming apparatus further comprises:

a control section configured to extract a predetermined parameter from the information output from the light-receiving section and to derive an amount of curl of the sheet passing in the sheet path.

2. The image forming apparatus according to claim 1, wherein the received light is light diffused in the predetermined diffusing direction from the sheet passing in the sheet path among the light emitted from the light source unit and then passed through an optical path defined in accordance with the amount of curl of the sheet passing in the sheet path.

3. The image forming apparatus according to claim 2, wherein the light emitted from the light source unit has quantities of light varying cyclically according to positions in the main-scanning direction;

wherein the information output from the light-receiving section indicates quantities of light shifting in the main-scanning direction in accordance with the amount of curl of the sheet passing in the sheet path; and wherein the control section extracts, as the predetermined parameter, a position in the main-scanning direction correlating with a peak value of the quantities of the received light indicated by the information output from the light-receiving section.

4. The image forming apparatus according to claim 3, wherein the control section carries out frequency analysis on the information output from the light-receiving section, thereby extracting the position in the main-scanning direction where the information output from the light-receiving section indicates a peak value of the quantities of the received light.

5. The image forming apparatus according to claim 2, wherein the light emitted from the light source unit includes rays having quantities of light varying cyclically according to positions in the main-scanning direction and having different cyclic lengths according to positions in the diffusing direction;

wherein the information output from the light-receiving section indicates quantities of received light varying cyclically according to positions in the main-scanning direction with a cyclic length depending on the amount of curl of the sheet passing in the sheet path; and wherein the control section extracts, as the predetermined parameter, the cyclic length of the quantities of received light varying according to positions in the main-scanning direction.

6. The image forming apparatus according to claim 5, wherein the control section carries out frequency analysis on the information output from the light-receiving section, thereby extracting the predetermined parameter from the information output from the light-receiving section.

7. The image forming apparatus according to claim 2, wherein the light emitted from the light source unit includes rays having quantities of light varying cyclically according to positions in the main-scanning direction and having different levels of quantities of light according to positions in the diffusing direction;

wherein the information output from the light-receiving section shows quantities of received light varying cyclically according to positions in the main-scanning direction in a level depending on the amount of curl passing in the sheet path; and wherein the control section extracts, as the predetermined parameter, the level of the quantities of received light varying according to positions in the main-scanning direction.

8. The image forming apparatus according to claim 7, wherein the control section carries out frequency analysis on the information output from the light-receiving section, thereby extracting a power at a predetermined spatial frequency from the information output from the light-receiving section.

9. The image forming apparatus according to claim 1, wherein the light source unit includes a light source having light emitting elements arranged in the main-scanning direction;

wherein, for detection of colors of the toner image formed on the sheet passing in the sheet path, the light source emits light elongated in the main-scanning direction and having substantially constant quantities of light regardless of positions in the main-scanning direction; and wherein, for detection of curl of the sheet passing in the sheet path, the light source emits light elongated in the main-scanning direction and having quantities of light varying according to positions in the main-scanning direction and according to positions in the height direction perpendicular to the sheet feed surface.

10. The image forming apparatus according to claim 1, wherein the sheet path includes:

a guide which the sheet fed from the fixing section passes over; and an upstream pressing member and a downstream pressing member located on the guide in the sheet path and respectively upstream and downstream from the irradiation area;

wherein, for detection of colors of the toner image on the sheet passing in the sheet path, the upstream pressing member and the downstream pressing member press the sheet passing over the guide against the guide; and wherein, for detection of the sheet passing in the sheet path, at least one of the upstream pressing member and the downstream pressing member is retracted upward from the guide.

11. The image forming apparatus according to claim 1, wherein the light source unit comprises:

an upstream light source configured to emit light to the irradiation area from an upstream side of the irradiation area for detection of curl in a leading portion with respect to the sheet feeding direction of the sheet passing in the sheet path, the light being elongated in the main-scanning direction different from the sheet feeding direction and having quantities of light varying according to positions in the main-scanning direction; and a downstream light source configured to emit light to the irradiation area from a downstream side of the irradiation area for detection of curl in a trailing portion with respect to the sheet feeding direction of the sheet passing in the sheet path, the light being elongated in the main-scanning direction different from the sheet feeding direction and having quantities of light varying according to positions in the main-scanning direction.

12. The image forming apparatus according to claim 1, wherein the light source unit comprises:

a light source, and an opaque board disposed between the light source and the sheet path, the opaque board having a plurality of openings arrayed in the main scanning direction to vary the quantity of light emitted toward the irradiation area in the main scanning direction, each of the openings being configured to vary the quantity of light emitted toward the irradiation area in accordance with the position of the light in the height direction.

13. The image forming apparatus according to claim 1, wherein the predetermined diffusing direction is orthogonal to the main scanning direction.

14. The image forming apparatus according to claim 1, wherein the light source unit comprises:

a first light source that illuminates the irradiation area with a constant quantity of light regardless of position in the main scanning direction, for reading the toner image, and a second light source that illuminates the irradiation area with light that varies in accordance with position in the main scanning direction, for deriving the amount of curl of the sheet.

* * * * *